United States Patent [19]

Jackson

[11] Patent Number: 4,854,722

[45] Date of Patent: Aug. 8, 1989

[54] APPARATUS FOR DISPENSING PARTICULATE MATERIAL

[75] Inventor: Miles Jackson, Cobourg, Canada

[73] Assignee: General Foods Inc., Ontario, Canada

[21] Appl. No.: 234,866

[22] Filed: Aug. 22, 1988

[51] Int. Cl.[4] ..... B01F 5/00

[52] U.S. Cl. ..... 366/341; 222/564

[58] Field of Search ..... 366/341, 9, 101, 106, 366/107, 10, 1, 184; 222/564, 145

[56] References Cited

U.S. PATENT DOCUMENTS 1,224,656 5/1917 Candliss ..... 366/9

4,286,883 9/1981 Johanson ..... 366/137

4,548,342 10/1985 Fisher ..... 222/145

4,795,266 1/1989 Johanson ..... 366/341

*Primary Examiner*—Robert W. Jenkins

*Attorney, Agent, or Firm*—Linn I. Grim; Daniel J. Donovan

[57] ABSTRACT

An apparatus is described for dispensing a composition of coarse and fine particles, comprising a bin section and a cone section. The bin section holds a supply of the composition, and the cone section includes inner and outer frusto-cones for conducting downward, respectively, first and second portions of the composition discharged from the bin section. These portions re-mix in the area directly below an outlet of the inner cone as the material is discharged from the dispensing device.

17 Claims, 2 Drawing Sheets

APPARATUS FOR DISPENSING PARTICULATE MATERIAL

BACKGROUND OF THE INVENTION

This invention generally relates to an apparatus for dispensing particulate materials, and more specifically, to an apparatus for dispensing a composition of course and fine particles.

Various food commodities, such as several cereal products, consist of a blend or mixture of coarse and fine particles. For example, some cereals include flakes having a range of sizes, and some of these flakes may be quite small while others may be comparatively large. Other cereals include sugar coated, puffed or flakes; and during handling and processing, small sugar particles may become separated from the much large flakes. These food products are often packaged by filling a large dispensing device with a bulk quantity of the commodity, and dispensing or feeding small quantities of the bulk mixture through a funnel that forms a bottom or lower portion of the dispensing device, into small, individual packages that are then prepared for sale to the consumer.

Prior art processes and apparatuses are known for dispensing food commodities of above-described type generally produce excellent results. However, difficulties are occasionally encountered with these prior art arrangements. For example, in U.S. Pat. No. 4,286,883 entitled "Blending Apparatus For Bulk Solids", the ingredients of the bulk composition tend to segregate from each other as they are poured into and subsequently passed downward through the dispensing device. Typically, the fine particles tend to collect in the center of the dispensing device, while the coarse particles tend to collect toward the sides of that device. Moreover, when the bulk composition is discharged from the dispensing device, initially product from the center of the device tends to flow out faster than product from the sides of the dispensing device. As a result, the food materials fed into the individual small packages do not always have the most preferred proportion of the different particulate ingredients. A similar result can be obtained in U.S. Pat. No. 4,548,342 in which a device is used for controlling the flow of particulate solid material through a bin having an internal hopper with inner and outer tapered surfaces which in this case requires a central channel and multiple segregated peripheral channels. These multiple channels can provide additional problems of particulate segregation in view of the variable flow of solids in each of the multiple channels.

One solution for the above problem has been defined in copending application U.S. Patent Application Ser. No. 861,478 filed May 9, 1986, which is assigned to the same assignee as is the present application, entitled "Apparatus For Dispensing A Blended Composition Of A Particulate Ingredient" wherein a conical plug is located in an apparatus similar to that of U.S. Pat. No. 4,286,883 to prevent a segregation of the individual materials of the mixture prior to the packaging step.

Also, on occasion, the particles will become jammed in the dispensing device. This interferes with the regular filling of the individual packages, and often an appreciable amount of time and effort is required by an operator to restart the flow of the food materials from the dispensing device. In addition, some of the coarse particles break apart as they pass through the dispensing device. As a result, over time, the proportion of coarse particles in the composition being discharged from the dispensing device may decrease while the proportion of fine particles in that composition may increase.

SUMMARY OF THE INVENTION

This invention describes an improved apparatus for dispensing large quantities of a blended composition of coarse and fine particles in a smooth and continuous manner without restricting product flow. Furthermore, the apparatus of this invention reduces or eliminates the amount of coarse ingredients, of a blend of coarse and fine particles, that break apart as that blend passes through a dispensing device providing a process to fill small packages with product from a bulk supply of coarse and fine particles while maintaining the proportion of coarse and fine particles in each of the filled packages or within an acceptable range of a constant valve.

The apparatus of this invention for dispensing a composition of coarse and fine particles comprises a bin section and a cone section. The bin section is provided for holding a supply of the blended composition and has an inlet for receiving the composition and an outlet for discharging the composition from the bin section. The cone section is located below the bin section to conduct particulate materials downward therefrom, and the cone section includes outer and inner cones. The outer cone is connected to and extends downward from the bin section, and has a first frusto-conical, annularly closed and downwardly inwardly sloping interior surface; and the inner cone is supported within the outer cone, and has a second, frusto-conical, annularly closed and downwardly inwardly sloping interior surface.

The inner and outer cones form an outer annulus therebetween; and, in use, a first portion of the composition discharged from the bin section is conducted downward through the inner cone, and a second portion of the composition discharged from the bin section is conducted downward through the outer annulus between the inner and outer cones. These portions re-mix in the area directly below the inner cone as the material is discharged from the dispensing device.

With one embodiment, the bin section and the outer cone of the cone section have circular horizontal cross sections, With an alternate embodiment, the bin section and the outer cone of the cone section have square or rectangular horizontal cross sections. Despite this significant difference between these two embodiments, the identical inner cone works effectively in both dispensing devices, first, to ensure mass flow downward through the dispenser, second, to better ensure that the proportion of coarse and fine particles discharged from the dispenser remains more constant over time, third, to ensure a smooth and regular flow of that material downward through the dispenser, and fourth, to reduce or eliminate any breaking of coarse particles passed through the dispenser.

Further benefits and advantages of the invention will become apparent from a consideration of the following detailed description given with reference to the accompanying drawings, which specify and show preferred embodiments of the invention.

A BRIEF DESCRIPTION OF THE DRAWINGS

DETAILED DESCRIPTION OF THE PREFERRED EMBODIMENTS

Figure 2:
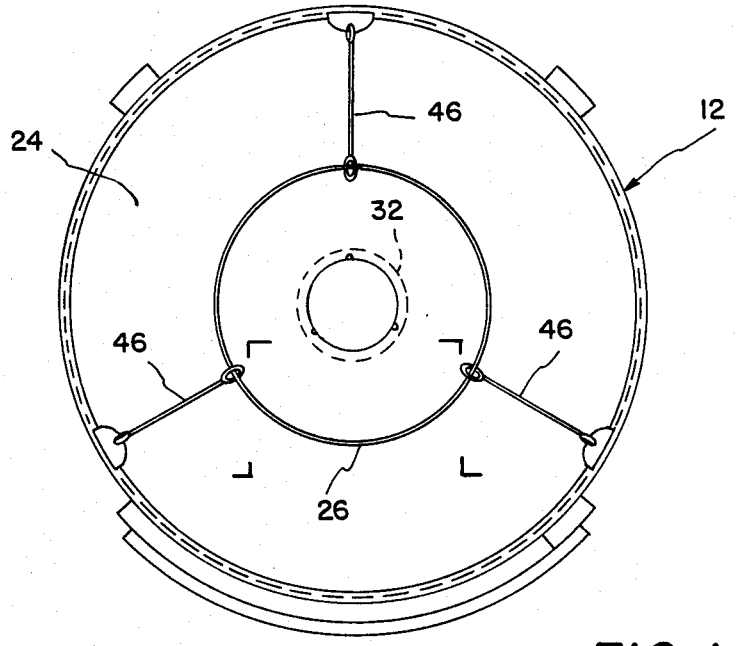
FIG. 2 is a top view of the dispensing device shown in FIG. 1.
Figure 1:
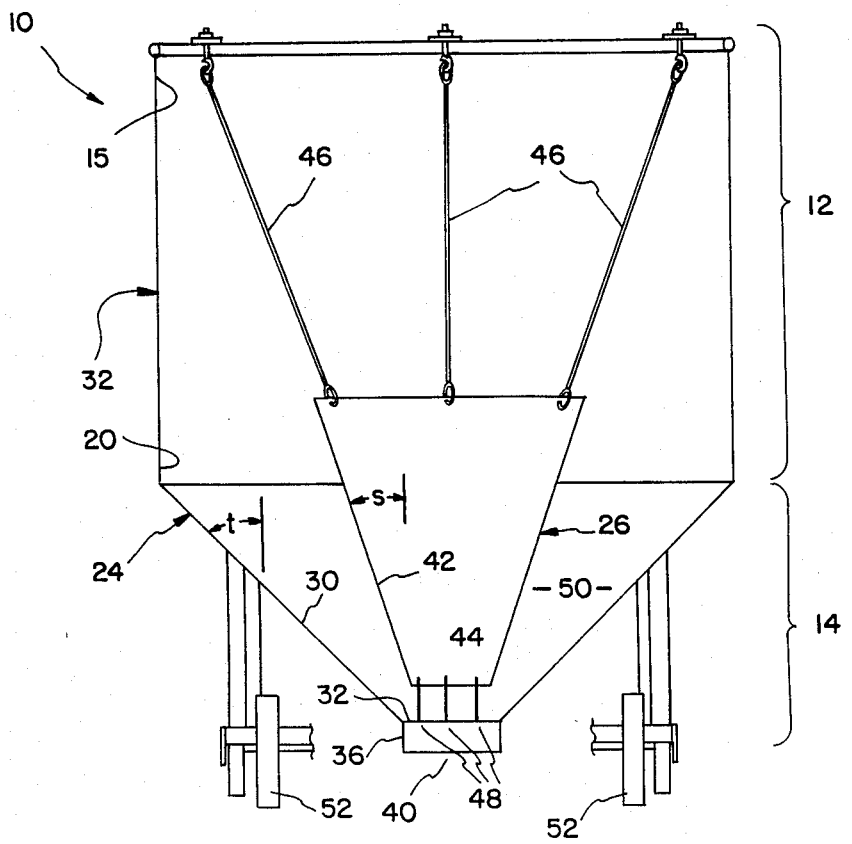
FIG. 1 is an elevation view in section showing one dispensing device according to this invention, and more specifically, illustrating a dispensing device having a generally circular shape.

FIGS. 1 and 2 illustrate dispensing apparatus 10 generally comprising top bin section 12 and cone section 14. Bin section 12 is provided for holding a supply of a composition of coarse and fine particles; and the bin section has inlet 16 for receiving the blended composition, and outlet 20 for discharging the composition from the bin section. Preferably, bin section 12 has a central vertical axis which defines the axis of apparatus 10, and the bin includes a vertical cylindrical wall 22 having a top edge, forming inlet 16, and a substantially open bottom, forming outlet 20. A top cover (not shown) having an inlet port or opening may be provided to cover the top of bin section 12.

Cone section 14 is located below bin section 12 for conducting downward particulate material discharged from the bin section, and also for holding a further supply of the blended composition, and this cone section includes outer and inner cones 24 and 26. Outer cone 24 is connected to and extends downward from bin section 12, preferably coaxially therewith; and the outer cone has a first, frusto-conical annularly closed and downwardly inwardly sloping interior surface 30 forming an angle "r" with the vertical. For example, outer cone 24 may be integrally connected to and extend downwardly from a bottom circumferential edge of cylindrical side wall 22, although other arrangements for connecting the outer cone 24 to bin section 12 may be used in the present invention. Outer cone 24 terminates in a bottom edge 32 that forms a central outlet opening; and outlet collar 36, which has a generally cylindrical shape, is connected to this bottom edge, extends downward therefrom and defines discharge outlet 40 to discharge material from dispensing device 10.

Inner cone 26 is supported within outer cone 24, and the inner cone has a second, frusto-conical, annularly closed and downwardly inwardly sloping interior surface 42 that forms an angle "s" with the vertical. Inner cone 26 terminates in a bottom edge 44 that forms a central outlet, which is directly above and closely adjacent the outlet of outer cone 24. Inner cone 26 may be supported in any suitable way, although preferably the inner cone is releasably held in cone section 14. For example, as illustrated in FIGS. 1 and 2, inner cone 26 may be held in place by a multitude of chains 46, each of which is connected to and extends between bin section 12 and the inner cone. More specifically, a first end of each of these chains 46 is connected to the top edge of side wall 22 of bin section 12, for example by means of an eye-bolt and ring; and a second end of each of these chains 46 is connected to the top edge of inner cone 26, for example, via a ring. Preferably, these first ends of chains 46 are equally spaced around the top edge of bin section 12, and the second ends of these chains are equally spaced around the top edge of inner cone 26.

Centering pins 48 may be connected to the lower portion of inner cone 26 to help maintain the bottom portion of that cone centered within cone section 14. As shown in FIG. 1, centering pins 48 are connected to and extend between outlet collar 36 and the lower peripheral portion of inner cone 26. Other arrangements may be used, though, and for example, the centering pins may be connected to and extend between lower portions of both the outer and inner cones 24 and 26.

As described above, outer and inner cones 24 and 26 define outer annulus 50 therebetween; and, in the operation of dispenser 10, discussed in greater detail below, a first portion of the composition discharged from bin section 12 is conducted downward through the inner cone 26, and a second portion of the composition discharged from the bin section is conducted downward through outer annulus 50. These first and second portions of the composition re-mix in the area directly below the outlet of inner cone 26 and are discharged from dispenser 10 via outlet collar 36.

Surfaces 30 and 42 satisfy various requirements. The first of these requirements is that the angle that each of these surfaces make with the horizontal be greater than the "surface friction angle," which is defined as the minimum angle between that surface and the horizontal at which the weight of the solids on the surface overcomes the frictional forces tending to prevent the solids from sliding down that surface.

Additional requirements may by surfaces 30 and 42 relate to a condition referred to as "mass flow", which in general is defined as a condition in which all of the solid material is being drawn out from the hopper. When a hopper of conical configuration is used to dispense or conduct a particulate material, there is a certain angle, measured between the interior surface of the hopper and the vertical, below which that material will exhibit mass flow but above which it will not. This angle which is normally emperically determined, is referred to as the "mass flow angle" for that specific combination of hopper and material.

With the embodiment of apparatus 10 that was actually reduced to practice, the angle "s" and the included angle whose magnitude is the difference "r"−"s" are each less than the mass flow angle for the particular composition dispensed from apparatus 10. It is not necessary, and indeed it may be preferred, that angle "r" itself be greater than the mass flow angle for the composition dispensed from apparatus 10.

Preferably, outer cone 24 slants downwardly inwardly at a first constant angle between its top and bottom edges, and the inner cone 26 slants downwardly inwardly at a second constant angle between its top and bottom edges. With the embodiment of dispenser 10 shown at FIG. 1, the top end and outer cone 24 is contiguous to the outlet 20 of bin section 12, and the bottom edge 32 of the outer cone is contiguous to outlet collar 36. Also, the top edge of inner cone 26 extends into bin section 12, and the bottom edge of the inner cone is adjacent outlet collar 36.

Even more specifically, with dispenser 10, "r" is preferably between 40° and 50° and most preferably approximately 45°, "s" is preferably between 16° and 18° and most preferably approximately 17°, and the bottom edge or outlet of inner cone 26 is preferably three to five inches, and most preferably approximately 4 inches, above bottom edge or outlet 32 of outer cone 24.

The diameter of the bottom outlet of the inner cone is preferably between 9 and 11 inches and most preferably approximately 10 inches, the diameter of the top edge of the inside cone is approximately 33 inches, and the height of this inner cone is approximately 35 inches. The diameter of the bottom outlet of outer cone is preferably between 11 and 13 inches and most preferably approximately 12 inches, the diameter of the top end of that outer cone is approximately 69 inches, and the height of the outer cone is approximately 31 inches. Moreover, preferably the apex of inner cone 26 is lower than the apex of outer cone 24; and as shown in FIG. 1, the lowermost edge of the outer cone is somewhat lower than the lowermost edge of the inner cone.

Dispenser 10 also includes a movable gate (not shown) to control the flow of particulate material from the dispenser. This gate member may be located in, above or below outlet collar 36; and the gate member has a closed position preventing particulate flow outward from the dispensing device, and an open position allowing particulate material to flow outward from the dispensing device. This gate member also may have a number of partially open positions, allowing particular material to be discharged from dispensing device 10 at various rates.

Dispenser 10 also includes a plurality of wheels 52 connected to cone section 14 in any suitable way to support the dispenser for movement over a surface. In a typical operation, device 10 is moved over a hole in a floor or similar surface. A chute is located in that hole and extends downward therefrom to guide material from dispenser 10 and into a multitude of packages that are passed beneath the chute. The above-mentioned control gate is closed to prevent particulate material from being discharged from dispensing device 10, and the entire dispensing device including cone section 14 and bin section 12 is filled with the desired composition. Then, the above-mentioned control gate is opened to feed material from apparatus 10, through the delivery chute and into small packages passed through the dispensing device.

It was found that, in the absence of inner cone 26, when the control gate of device 10 was initially opened, material from the center of the dispenser flowed outward at a rate faster than the material from the sides of the dispenser. Since fine particles tended to congretate in the center of the dispenser, this resulted in a larger than preferred proportion of fine particles in the first few packages filled from the dispenser. It is believed that adding inner cone 26, first, decreases the rate at which particles flow down through the center of the dispenser 10, and also increases the rate at which particles flow down from the sides of the dispenser. A balance was obtained resulting in the proportion of fine and coarse particles being discharged from the dispenser at a rate close to a desired constant value. Furthermore, adding inner cone 26 improved the flow of particles downward through the dispenser; and in particular, that flow is much smoother, and jamming of the particles in the dispenser has been virtually eliminated. In addition, it has been found that with the presence of inner cone 26, the tendency of any coarse particles in the composition to break has been dramatically decreased.

In the above-described embodiment of the invention, outer and inner cones 24 and 26 are both frusto-conical right circular cones. However, the present invention is not limited to right circular cones; and the word "cone" as used herein and in the appended claims is defined by the general definition: any surface generated by moving a straight line that passes through a fixed point, along a closed horizontal path spaced from that point.

It will be recognized that, when cones other than right frusto-cones are used in the practice of the present invention, the above-discussed relationships between the positions and orientations of the surfaces of outer and inner cones 24 and 26 apply to each portion of the outer cone and the most nearly contiguous portion of the inner cone.

Figure 4:
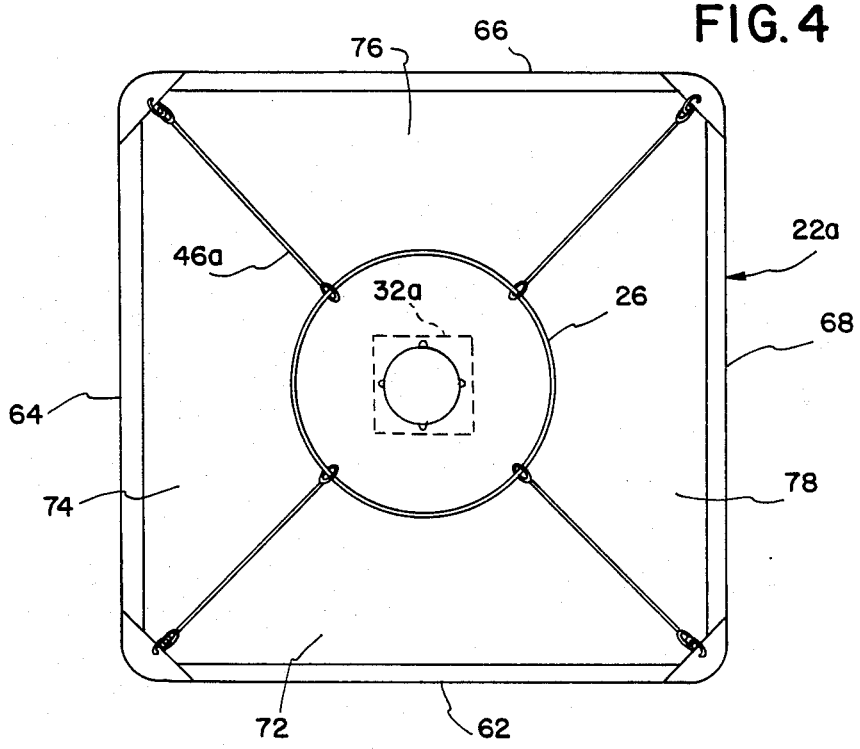
FIG. 4 is a top view of the dispensing device of FIG. 3.
Figure 3:
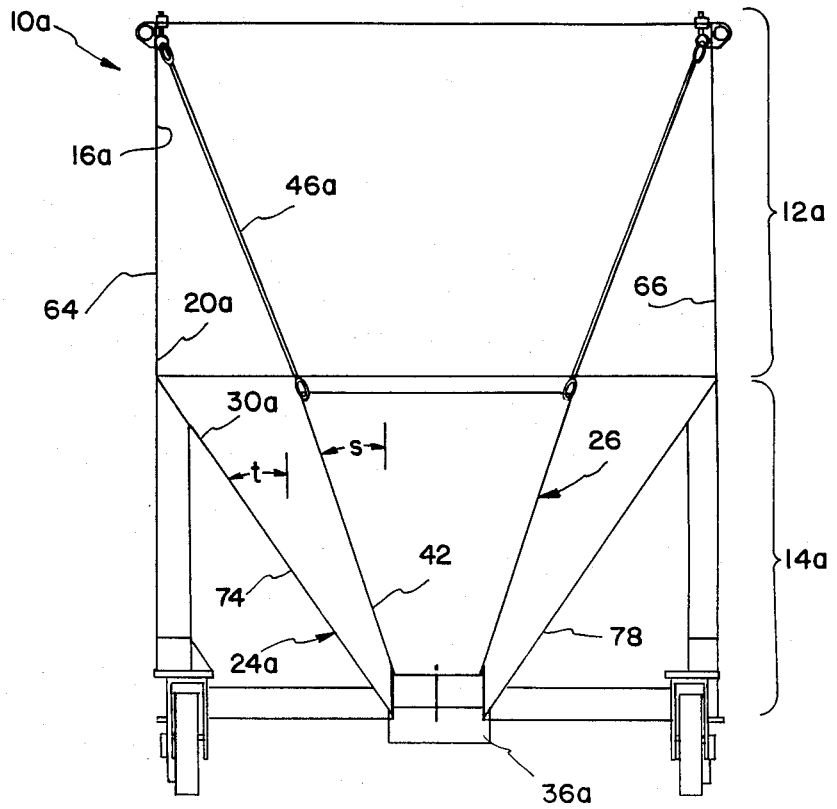
FIG. 3 is an elevation view in section of an alternate dispensing device according to the present invention, and having a generally square shape.

FIGS. 3 and 4 illustrate an alternate dispensing device **10*a*. Device 10*a* is generally similar to device 10, and elements of the former device that correspond to elements of the latter device are given the same reference number as that corresponding element but with the added suffix "a." Thus, generally, dispensing device 10*a* comprises top bin section 12*a* and cone section 14*a*. Bin section 12*a* includes cylindrical side wall 22*a* forming top inlet 16*a* and bottom outlet 20*a*. Cone section 14*a* is connected to and extends downward from bin section 12*a*, and the cone section includes outer cone 23*a*. The inner cone of dispensing device 10*a* is identical to cone 26 of apparatus 10, and thus the parts of the inner core of device 10*a* are given the same reference numbers as they are given in FIGS. 1 and 2**.

Similar to surfaces 30 and 42 of device 10, the angles that surfaces **30*a* and 42 of device 10*a* make with the horizontal are greater than the surface friction angle for the composition being dispensed through device 10*a*. Also, the angle "s" and the included nagle whose magnitude is the difference "t" minus "s" are each less than the mass flow angle for the particular composition dispensed from apparatus 10*a***. Angle "t" itself need not be greater than that mass flow angle.

The principle difference between dispensing devices 10 and **10*a* is that bin section 12 and outer cone 24 of the former device have circular horizontal cross sections, while bin section 12*a* and outer cone 24*a* of device 10*a* have square horizontal cross sections. More specifically, bin section 12*a* comprises four generally planar wall members, referenced in FIGS. 3 and 4 as 62, 64, 66 and 68, and these sections are connected together in a box-shape with open top and bottom ends. Similarly, outer cone 24*a* includes four generally planar side members referenced in FIGS. 3 and 4 as 72, 74, 76 and 78. Member 72 slants downwardly inwardly from the bottom edge of bin member 62, at an angle "t" to the vertical; and cone member 74 slants downwardly inwardly from the bottom edge of bin member 64, also at that angle "t" to the vertical. Likewise, member 76 slants downwardly inwardly from the bottom edge of bin member 66, and member 78 slants downwardly inwardly from the bottom edge of member 68, with both members 76 and 78 forming an angle "t" to the vertical. Each of the cone members has a generally truncated triangular shape, and the bottom edges of these cone members form outer cone outlet 32**a.

Preferably, "t" is between 30° and 40°, outlet 34a of outercone **24*a* has a square shape, with each side of this square being 11 to 13 inches long, and the height of outer cone 24*a* is between 38 and to 42 inches. Each side of bin section 12 has a width between 66 and 72 inches, and the length of the top edge of each member of outer cone 24*a* is also between 66 and 72 inches. With one embodiment of apparatus 10*a* that was actually reduced to practice, angle "t" is approximately 35°, the outlet of outer cone 24*a* has a square shape, with each side of the square being 12 inches long. The height of the outer cone is about 40½ inches, and the height of the bin section 12a is about 43½ inches. Each side member of bin section 12a has a width of approximately 69 inches, and this is also the length of the top edge of each member of outer cone 24a**.

The dimensions of inner cone 26 are the same as given above in connection with dispenser 10; and with device 10a, the bottom outlet of the inner cone also is preferably 3 to 5 inches, and most preferably about 4 inches, above the bottom outlet of the outer cone.

The operation of device 10a is very similar to the operation of device 10, and it is unnecessary to describe that operation again herein in detail. Briefly, dispenser 10a is filled with the desired composition. The control gate (not shown) of device 10a is opened to allow the particulate material to flow downward through inner cone 26 and outer cone 24a. This material is discharged from the dispensing device through outlet collar 36a and into small packages passed beneath the dispensing apparatus 10.

Despite the significant differences between the devices 10 and 10a, it was found that the identical inner cone 26 works effectively in both dispensing device, first, to ensure mass flow downward through the dispenser, second, to better ensure that the proportion of coarse and fine particles discharged from the dispenser remains more constant over time, third, to ensure a smooth and regular flow of that material downward through the dispenser, and fourth, to reduce or eliminate any breaking of coarse particles passed through the dispenser.

The apparatus of this invention demonstrates improvements for dispensing solid particulate materials having coarse and fine materials. In the use of flaked cereal in the apparatus of this invention, as the flaked cereal flows through the bin, a smooth and constant flow is observed with exceptionally low amounts of deterioration of the coarse flakes to the fine flakes i.e., significantly reduced segragation and breakage of the flake cereal occurs compared to the flake flow-through in a standard bin. All products flowing through the apparatus of this invention are evenly proportioned with fine and coarse flakes without segregation of the product.

While it is apparent that the invention disclosed herein is well calculated to fulfill the desired results previously stated, it will be appreciated that numerous modifications and embodiments may be devised by those skilled in the art, and it is intended that the appended claims cover all such modifications and embodiments as fall within the true spirit and scope of the present invention.

What is claimed is:

1. An apparatus for dispensing a composition of coarse and fine particles comprising:

a bin section for holding a supply of the blended composition, and having an inlet for receiving the composition from the bin section; and a cone section located below the bin section, and including (i) an outer cone connected to and extending downward from the bin section, and having a first frusto-conical, annularly closed and downwardly inwardly sloping interior surface, and (ii) an inner cone supported within the outer cone, and having a second frusto-conical, annularly closed and downwardly sloping interior surface to conduct downward a first portion of the composition discharged from the bin section, the inner and outer cones forming an outer annulus therebetween to conduct downward a second portion of the composition discharged from the bin section, the outer cone including a bottom edge forming an outlet opening to discharge the composition from the cone section, the inner cone including a bottom edge forming an outlet opening to discharge said first portion of the composition from the inner cones, and the outlet opening of the inner cone having a diameter between 11 and 13 inches and being three to five inches above the outlet opening of the outer cone, and the interior surface of the inner cone forming an angle between 16° and 20° with the vertical.

2. An apparatus according to claim 1, wherein the outlet opening of the inner cone is approximately four inches above the outlet opening of the outer cone.

3. An apparatus according to claim 2, wherein the interior surface of the inner cone forms an angle of approximately 18° with the vertical.

4. An apparatus according to claim 2, wherein:

the inner cone includes a top edge defining an inner cone inlet; and the inner surface of the inner cone slants inwardly downwardly at a constant angle of approximately 18° to the vertical, from the top edge of the inner cone to the bottom edge thereof;

the inner cone inlet has a diameter of approximately 33 inches; and the inner cone outlet has a diameter of approximately 10 inches.

5. An apparatus according to claim 4, wherein the outer cone includes a top edge defining an opening having a diameter of approximately 70 inches;

the outer cone outlet has a diameter of approximately 12 inches;

the inner surface of the outer cone slants inwardly downwardly at a constant angle between 40° and 50° to the vertical, from the top edge of the outer cone to the bottom edge thereof.

6. An apparatus according to claim 5, wherein the outer cone is a right frusto-cone.

7. An apparatus according to claim 6, wherein the top edge of the inner cone is located inside the bin section.

8. An apparatus according to claim 4, wherein:

the outer cone included first, second, third, and fourth side members, each of the side members having the shape of a truncated triangle, and including top and bottom edges;

the top edge of each side member is approximately sixty-nine inches long; the bottom edge of each side member is approximately twelve inches long; and the first, second, third, and fourth side members are connected together, with the top edges of the side members forming a square opening, and with the bottom edges of the side members forming the bottom edge of the outer cone and defining said outer cone outlet.

9. An apparatus according to claim 8, wherein each of the first, second, third, and fourth side members slants inwardly downwardly at a constant angle between 30° and 40° to the vertical, from the top edge of the side member to the bottom edge thereof.

10. An apparatus according to claim 1, further including means for releasably holding the inner cone in the cone section.

11. An apparatus according to claim 10, wherein the means releasably holding the inner cone in the cone section includes a multitude of chains, each of said chains being connected to, and extending between, the bin section and the inner cone.

12. An apparatus according to claim 11, wherein said chains are connected to, and are equally spaced around an upper portion of the inner cone.

13. An apparatus according to claim 12, wherein said chains are connected to, and are equally spaced around an upper edge of the inner cone.

14. An apparatus according to claim 13, wherein said chains are also connected to, and are equally spaced around an upper edge of the bin section.

15. An apparatus according to claim 11, further including a plurality of centering pins connected to a lower portion of the inner cone to maintain the inner cone in a centered position in the cone section.

16. An apparatus according to claim 15, further including a discharge collar connected to and extending downward from the outlet of the inner cone and to discharge the composition from the dispenser, and wherein the centering pins are connected to, and extend between, the discharge collar and the lower portion of the inner cone.

17. An apparatus according to claim 16, wherein the centering pins are equally spaced around the lower portion of the inner cone.

* * * * *